US008462974B2

(12) United States Patent
Jeong et al.

(10) Patent No.: US 8,462,974 B2
(45) Date of Patent: Jun. 11, 2013

(54) APPARATUS FOR TRANSMITTING AND RECEIVING SOUND

(75) Inventors: Chi Hwan Jeong, Seoul (KR); Young Joo Yee, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 1295 days.

(21) Appl. No.: 12/025,597

(22) Filed: Feb. 4, 2008

(65) Prior Publication Data

US 2008/0212815 A1 Sep. 4, 2008

(30) Foreign Application Priority Data

Feb. 5, 2007 (KR) ..... 10-2007-0011504

(51) Int. Cl.
*H04R 25/00* (2006.01)

(52) U.S. Cl.
USPC ..... 381/331; 381/317; 381/318

(58) Field of Classification Search
USPC ..... 381/318–331
See application file for complete search history.

(56) References Cited

U.S. PATENT DOCUMENTS

| | | | | |
|---|---|---|---|---|
| 3,757,769 | A * | 9/1973 | Arguimbau et al. | 600/559 |
| 7,769,185 | B2 * | 8/2010 | Burns | 381/60 |
| 2002/0057815 | A1 * | 5/2002 | Killion | 381/313 |
| 2003/0133588 | A1 * | 7/2003 | Pedersen | 381/423 |

FOREIGN PATENT DOCUMENTS

| | | | |
|---|---|---|---|
| KR | 10-0675023 | B1 | 1/2007 |
| TW | I240589 | B | 9/2005 |
| WO | WO-93/11703 | A | 6/1993 |
| WO | WO-01/91843 | A | 12/2001 |

* cited by examiner

*Primary Examiner* — Steven Loke
*Assistant Examiner* — Jonathan Han
(74) *Attorney, Agent, or Firm* — Birch, Stewart, Kolasch & Birch, LLP

(57) ABSTRACT

The apparatus for transmitting and receiving sound is disclosed, wherein a directional microphone for detecting sound for transmission is applied and a sound output unit for outputting the received sound is arranged at a side of the directional microphone where sensitivity is low, thereby preventing sound coupling for received sound and sound for transmission without recourse to complicated signal processing to attenuate the echo and howling.

11 Claims, 8 Drawing Sheets

APPARATUS FOR TRANSMITTING AND RECEIVING SOUND

CROSS-REFERENCE TO RELATED APPLICATION

The present application is based on, and claims priority from, Korean Application Number 10-2007-0011504, filed Feb. 5, 2007 the disclosure of which is incorporated by reference herein in its entirety.

BACKGROUND

The following description relates generally to an apparatus for transmitting and receiving sound.

Typically, a microphone is a kind of sensors for detecting sound wave or vibration of ultrasonic wave and converting the sound wave or the vibration to an electric signal as an output. Microphones are used as a sound input apparatus in, for example, a recorder, a telephone, a loudspeaker and a hearing device.

Omni-directional microphones have one sound entry opening and ideally accept sound from all directions equally to be susceptible to noise, and for that reason, directional microphones are frequently used to accentuate a useful acoustic signal in an environment filled with interference noise.

FIGS. 1*a* and 1*b* illustrate a schematic constitutional view of a conventional omni-directional microphone and a sensitivity characteristic representation in response to sound input direction.

The omni-directional microphone is held adjacent mouth of the user from which sound comes out in order to arrange the microphone nearest to the sound source when the microphone is used in a voice recorder or an car-set for sound detection.

However, as illustrated in FIG. 2, an ear-hole (completely-in-the-canal) sound transmitter/receiver (10) has been developed that receives sound by detecting sound variations generated from a hole (21) of an ear (20) through vibration of ear drum during speaking instead of sound from a mouth. The ear-hole sound transmitter/receiver (10) has an advantage in that it is physically small in size, small enough to fit into a completely-in-the-canal (CIC) hearing aid and it can minimize environmental noise.

There is a disadvantage however in the ear-hole sound transmitter/receiver in that, as input and output of sound are simultaneously realized in the ear holes, sound output of the receiver may be re-inputted into the microphone to become the causes of echo and howling when the omni-directional microphone is employed. Worse yet, a need exists for additional complex signal process for eliminating or attenuating the echo and howling, thereby increasing the sizes and the manufacturing/development costs of the ear-hole sound transmitter/receiver.

SUMMARY

An object of the present novel concept is to provide an apparatus for transmitting and receiving sound wherein a directional microphone for detecting sound for transmission is applied and a sound output unit for outputting the received sound is arranged at a side of the directional microphone where sensitivity is low to thereby attenuate the echo and howling.

Another object is to provide an apparatus for transmitting and receiving sound wherein a directional microphone is applied to detect sound for transmission, thereby improving the SNR (Signal-to-Noise Ratio).

Yet another object is to provide an apparatus for transmitting and receiving sound wherein interference noise in ear-holes caused by the received sound and utterance of a user can be attenuated even when the sound received from a sound output unit is being outputted to increase the detection efficiency of the sound in the ear-holes and to perform the full duplexing.

In one general aspect, an apparatus for transmitting and receiving sound comprises: a sound waveguide which is a pipe formed with one opening and the other opening, wherein at least two or more through holes are formed on the pipe by passing therethrough, a first sound is inputted into said one opening and a second sound is inputted into said other opening; a sound output unit disposed at said one opening of the sound waveguide to output the first sound to the sound waveguide; and a directional microphone for detecting the second sound by the through holes of the sound waveguide.

DETAILED DESCRIPTION

Exemplary implementations of the present disclosure will be illustrated in detail with reference to the accompanying drawings.

Figure 1A:
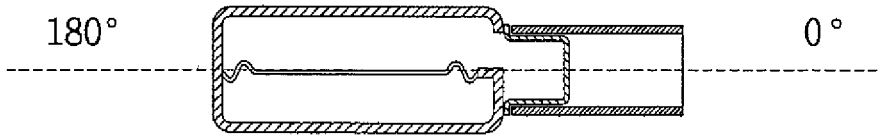
FIGS. 1*a* and 1*b* are a schematic constitutional view illustrating a conventional omni-directional microphone and a sensitivity characteristic representation in response to a sound input direction.
Figure 1B:
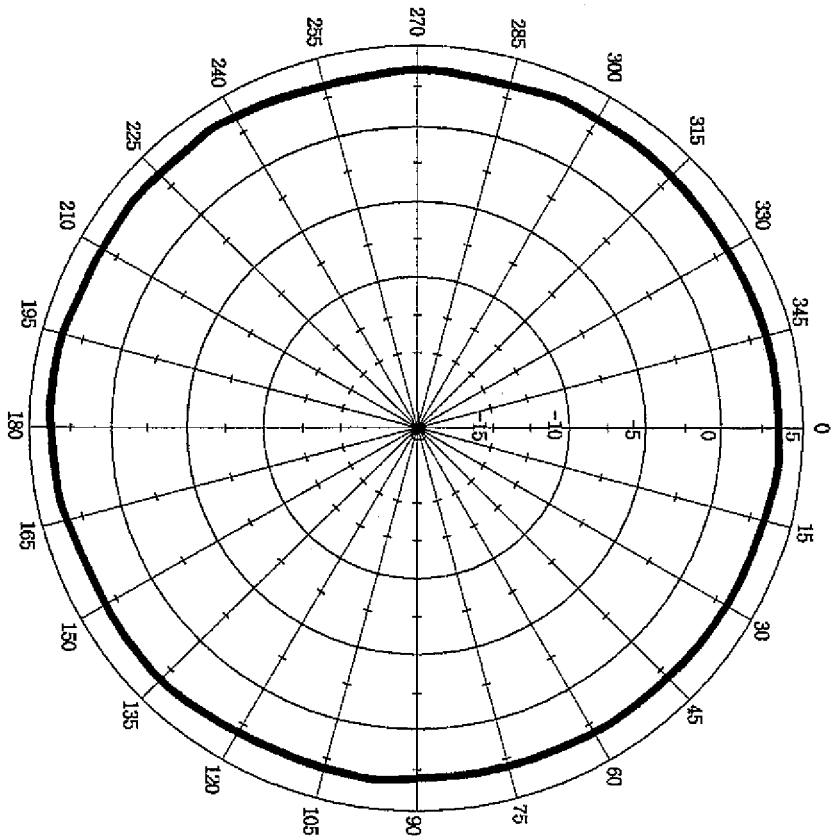
Figure 2:
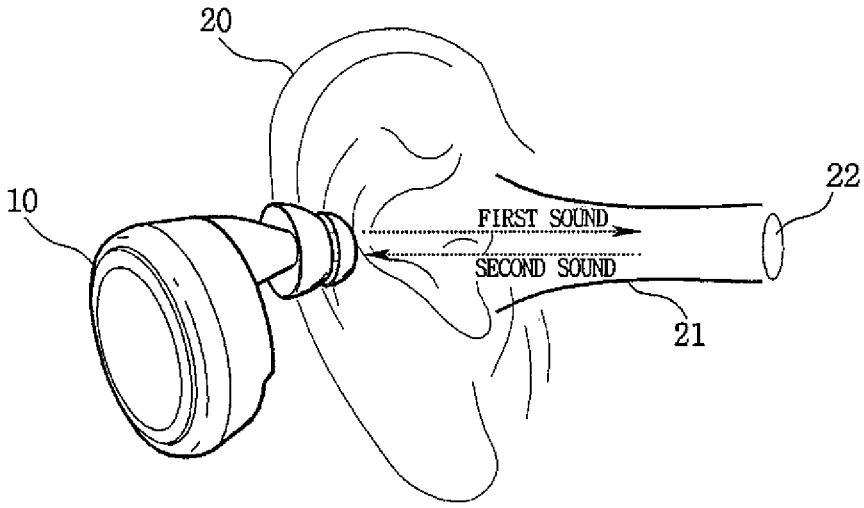
FIG. 2 is a schematic view of an ear-hole sound transmitter/receiver according to prior art.
Figure 3:
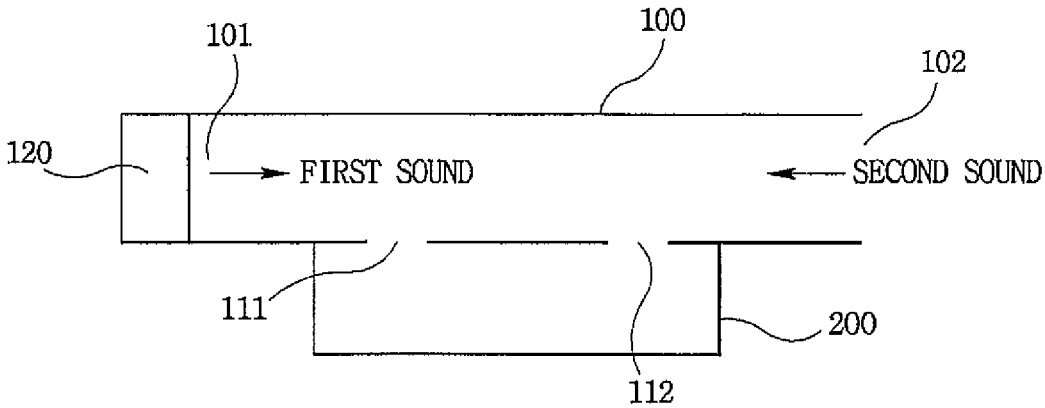
FIG. 3 is a schematic view illustrating an apparatus for transmitting and receiving sound according to the present inventive concept.

Referring to FIG. 3, an apparatus for transmitting and receiving sound (hereinafter referred to as the apparatus) may comprise: a sound waveguide (100) which is a pipe and formed with one opening (101) and the other opening (102), wherein at least two or more through holes (111, 112) are formed on the pipe by passing therethrough, a first sound is inputted into said one opening (101) and a second sound is inputted into said other opening (102); a sound output unit (120) formed at said one opening (101) of the sound waveguide (100) to output the first sound to the sound waveguide (100); and a directional microphone (200) for detecting the second sound by the through holes (111, 112) of the sound waveguide (100).

The apparatus may work in such a manner that a first sound (received) is inputted into one opening (101) of the sound waveguide (100) and a second sound (to be transmitted) is inputted into the other opening (102). The sound waveguide (100) may be formed with at least two or more through holes (111, 112) through which the second sound is inputted into the directional microphone (200), where the directional microphone (200) may detect the second sound and transmits a second sound signal.

The directional microphone preferably has one directional pattern out of such patterns as a cardoid pattern, a hypercardoid pattern and a secondary directional pattern.

The cardoid pattern may be embodied by a directional microphone formed with two sound detection passages, and the secondary directional pattern may embody the directional pattern by arrangement of three or more microphones.

Meanwhile, the first sound is a sound wirely or wirelessly received from an outside device to the apparatus according to the present novel concept, while the second sound is a sound that is detected by the directional microphone (200) and transmitted wirely or wirelessly to the outside device.

The directional microphone preferably includes a microphone detecting sound by using electromagnetism, a microphone detecting sound by using electrostatic capacity, and a microphone detecting sound by using piezoelectricity.

Furthermore, the first sound is preferably a sound that advances from the sound output unit to the ear drum, while the second sound is preferably a sound that is generated from vibration of the ear drum by utterance of a user.

Still furthermore, the first sound is preferably a sound that is received wirely or wirelessly from an outside device, while the second sound is preferably a sound that is detected by the directional microphone and that is wirely or wirelessly transmitted to the outside device.

The directional microphone (200) may comprise plural structures, and each of the plurality of directional microphones may comprise a directional microphone for detecting the second sound inputted into the through holes of the sound waveguide (100).

Figure 4:
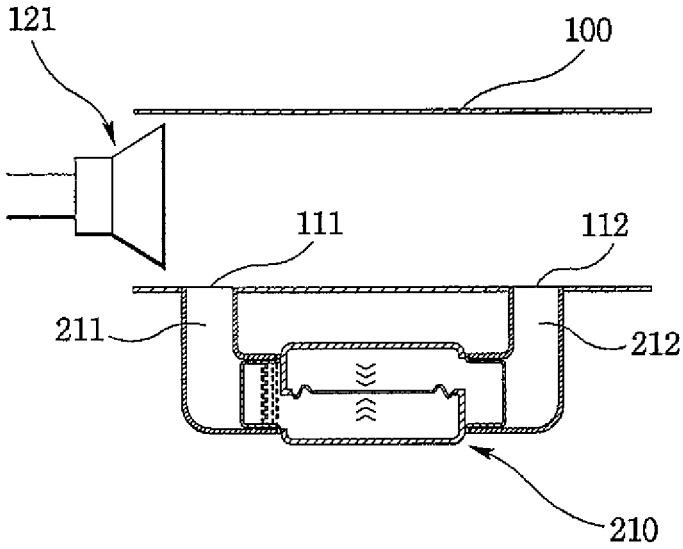
FIG. 4 is a schematic constitutional view illustrating an apparatus for transmitting and receiving sound according to an exemplary implementation.

FIG. 4 is a schematic constitutional view illustrating the apparatus according to an exemplary implementation, wherein the sound output unit (120) disposed at one opening of the sound waveguide (100) may be a speaker (121) for outputting the first sound that is received, and the directional microphone (200) for receiving the second sound through the through holes (111, 112) of the sound waveguide (100) to output a sound signal may be a directional microphone (210) disposed with first and second detection passage (211, 212).

Therefore, the directional microphone (210) equipped with the first and second detection passage (211, 212) may receive most of the input from the second sound as sensitivity of the first sound outputted from the speaker (121) is low while that of the second sound is high.

Figure 5A:
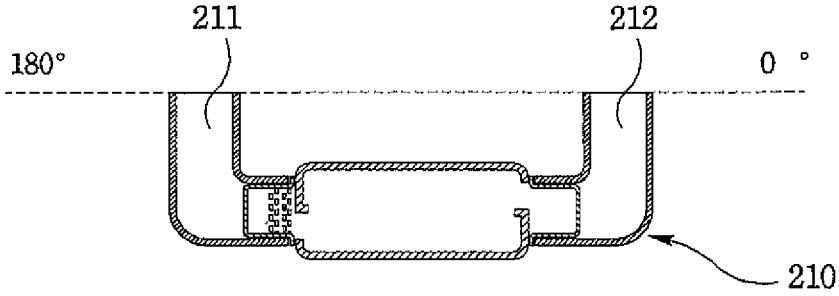
FIGS. 5*a* and 5*b* are a schematic constitutional view illustrating a directional microphone and a sensitivity characteristic representation in response to a sound input direction according to the present inventive concept.
Figure 5B:
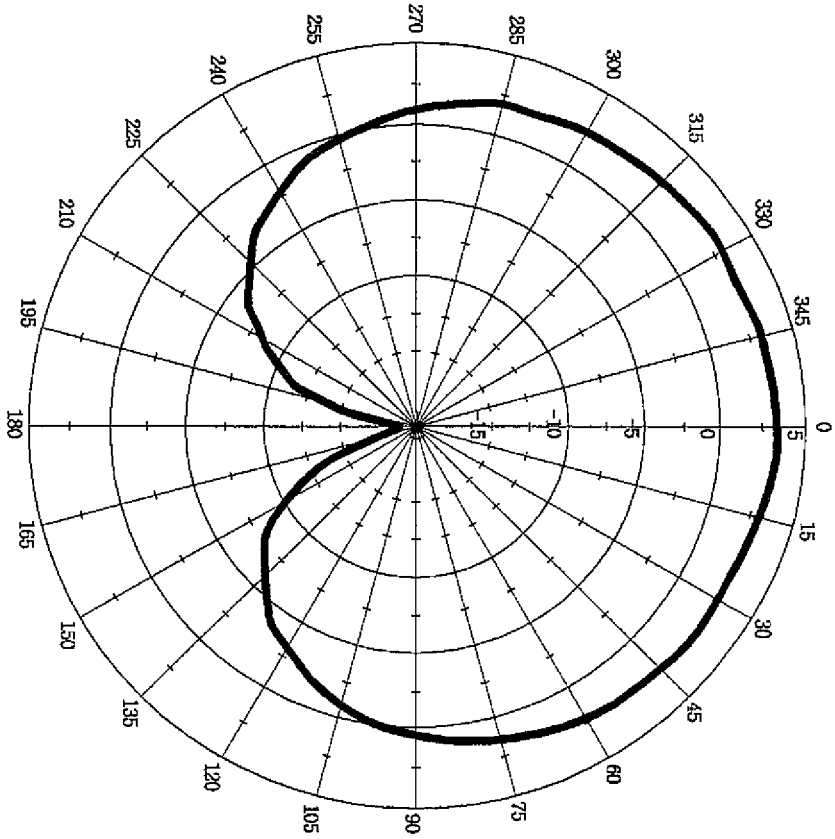

FIGS. 5*a* and 5*b* are a schematic constitutional view illustrating a directional microphone and a sensitivity characteristic representation in response to a sound input direction according to the present inventive concept.

The directional microphone (210) mounted with the first and second detection passage (211, 212) works in such a fashion that detection sensitivity from the second detection passage (212) is high while that of the first detection passage (211) is low.

In other words, as illustrated in FIG. 5*b*, it can be noticed that the sensitivity is the highest at the front (0°) and the lowest at the rear (180°) in terms of sensitivity feature in response to sound input direction.

Accordingly, the directional microphone formed at the apparatus of the instant novel feature is positioned toward a sound source to be transmitted to a direction where the sensitivity of the directional microphone is high, whereby the detected sound signal is higher than noise to help improve the SNR (Signal to Noise Ratio).

Figure 6:
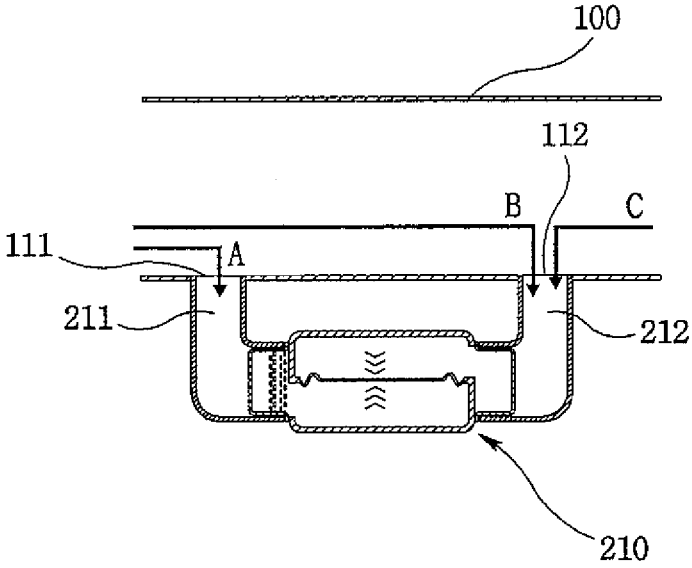
FIG. 6 is a schematic view illustrating a feature of a directional microphone according to the present inventive concept.

FIG. 6 is a schematic view illustrating a feature of a directional microphone according to the present inventive concept, where the sound detection passages (211 212) of the directional microphone (210) are connected to the through holes (111, 112) of the sound waveguide (100), and the first sound outputted from the sound output unit is inputted into the first and second detection passage (211, 212) of the directional microphone. The second sound (C) is inputted into the second detection passage (212).

A first sound element (A) inputted into the first detection passage (211) and a first sound element (B) inputted into the second detection passage (212) create a phase difference in response to time delay. As a result, the first sound elements (A, B) respectively inputted into the first and second detection passage (211, 212) are offset by the phase difference to make the sensitivity low, whereas the sensitivity of the first sound at the directional microphone grows low while that of the second sound becomes high in response to the feature of the directional microphone where the sensitivity of a second sound element (C) inputted into the second detection passage (212).

Therefore, as described in the foregoing, because the sensitivity of the second detection passage (212) of the directional microphone (210) is the highest while that of the first detection passage (211) is the lowest, if the directional microphone is applied to the apparatus, there is a high likelihood of reducing interference noise between input/output sounds and blocking outside noise to further clearly detect the sound signal.

Meanwhile, the present novel idea may be constructed in such a way that there are two through holes at the sound waveguide, the directional microphone communicates with the two through holes with two ports, each port having a different sound detection sensitivity, the directional pattern of which is a cardoid pattern, and the sound output unit is arranged near the port where the sound detection sensitivity is low.

Figure 7:
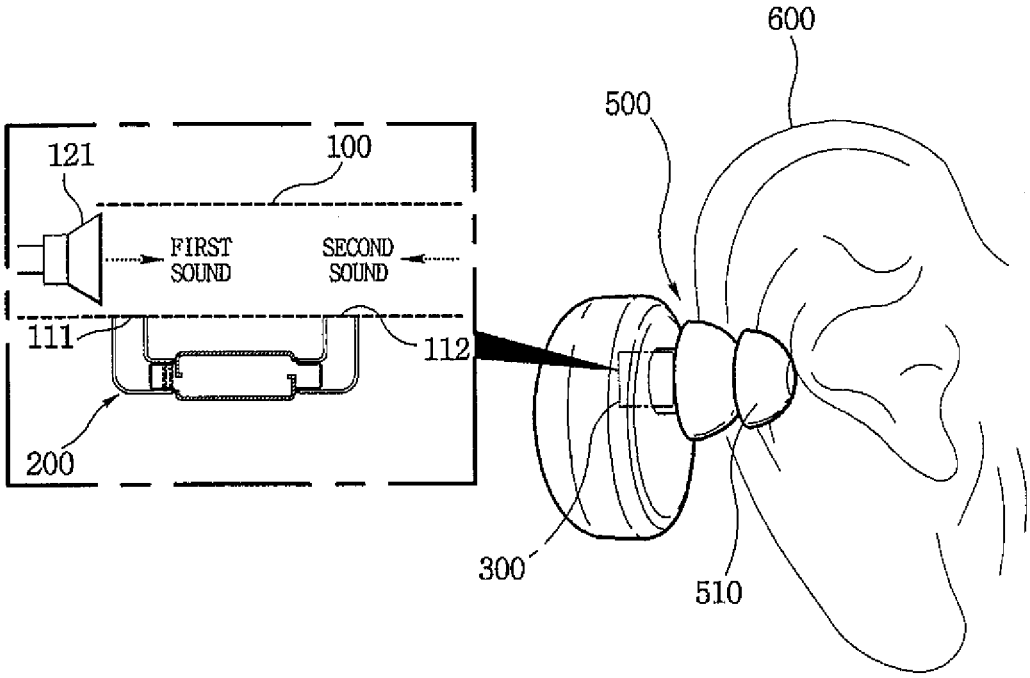
FIG. 7 is a schematic view illustrating a canal type ear-hole sound transmitter/receiver formed with a built-in apparatus for transmitting and receiving sound.

FIG. 7 is a schematic view illustrating a canal type ear-hole sound transmitter/receiver (500) formed with a built-in apparatus for transmitting and receiving sound.

The canal type ear-hole sound transmitter/receiver (500) may be used by being inserted into an external auditory meatus (completely in the canal). As shown in FIG. 7, the canal type ear-hole sound transmitter/receiver (500) may be configured with an apparatus for transmitting and receiving sound (300) according to the present novel concept.

In other words, as illustrated in FIG. 7, the apparatus (300) may include a sound waveguide (100) formed with at least two or more through holes (111, 112) and formed with one opening into which a received first sound is inputted and the other opening into which a second sound to be transmitted is inputted, a speaker (121) formed at said one opening of the sound waveguide (100) to output the first sound, and a directional microphone (200) for receiving the second sound via the through holes (111, 112) of the sound waveguide (100) to output a sound signal.

A port (i.e., a port at 180° of FIG. 7) where the detection sensitivity of the directional microphone (200) is low may be aligned adjacent the speaker (121), while a port (i.e., a port at 0° of FIG. 7) where the sensitivity is the highest may be so aligned as to allow the second sound to be inputted.

In doing so, the first sound outputted from the speaker (121) may be transmitted to the ear drums of a user, where signal size thereof is low because the first sound is inputted from a direction where the sensitivity of the directional microphone (200) is low. The second sound, which is a voice generated by vibration of the ear drums when a user speaks, is high in signal size thereof because the second sound is inputted from a direction where the sensitivity of the directional microphone (200) is the highest.

Under these circumstances, because the speaker (121) is connected to an antenna and a sound processor (not shown), sound wirelessly transmitted from a remote location is received by the antenna, processed by the sound processor and outputted to the speaker (121).

The directional microphone (200) is also connected to the antenna and the sound processor (not shown), such that the second sound sensed by the directional microphone (200) is processed by the sound processor and transmitted to the antenna.

The ear-hole (in-the-canal) sound transmitter/receiver is inserted into an ear hole of an ear (600) to transmit the received first sound into the ear drum, and to transmit the second sound generated from the ear drum of the ear (600) to a remote location through the sound waveguide and the directional microphone (200).

The other opening of the sound waveguide (100) is preferably connected to an ear plug (510). At that, less interference may be generated between the first sound and the second sound to allow the sound output to be effectively transmitted to the user, thereby detecting the user's sound with the restrained distortion caused by the sound output.

Furthermore, the ear plug (510) inserted into the ear hole including the external auditory meatus may serve to block the ear hole and to exclude outside sounds. The outside noise may not be detected therefore because the outside noise is inputted into a direction where the sensitivity of the directional microphone (200) is low.

Figure 8:
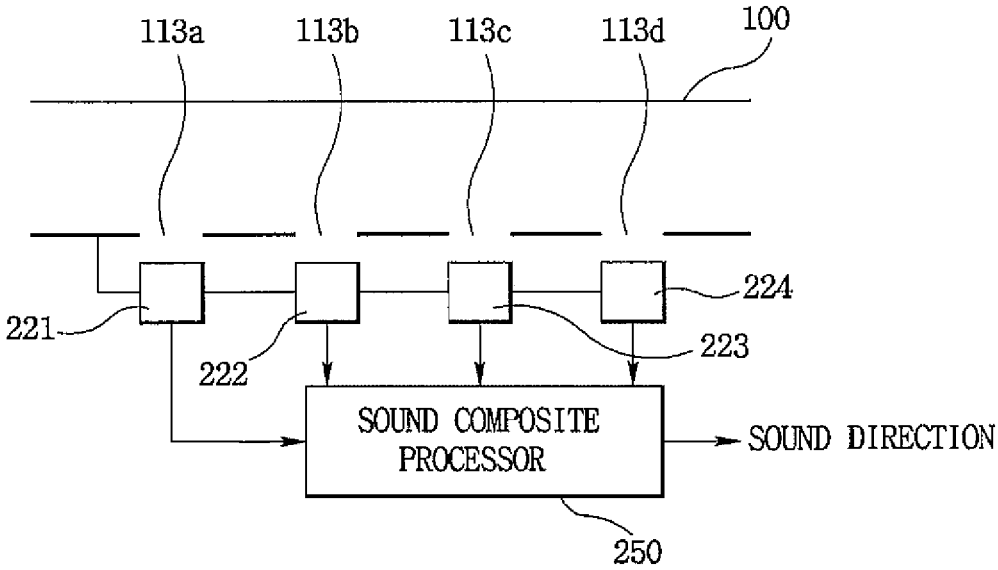
FIG. 8 is a schematic view illustrating an apparatus for transmitting and receiving sound according to another exemplary implementation.

FIG. 8 is a schematic view illustrating an apparatus for transmitting and receiving sound according to the present inventive concept.

Referring to FIG. 8, the sound waveguide (100) may be formed with a plurality of through holes (113*a*, 113*b*, 113*c*, 113*d*) and a plurality of microphones (221, 222, 223, 224) may be aligned correspondingly opposite to the plurality of through holes (113*a*, 113*b*, 113*c*, 113*d*). Each of the plurality of microphones (221, 222, 223, 224) may be a directional microphone having a secondary directional pattern. The second sound detected by the plurality of microphones (221, 222, 223, 224) may be compositely processed and outputted by a sound composite processor (250).

Figure 9:
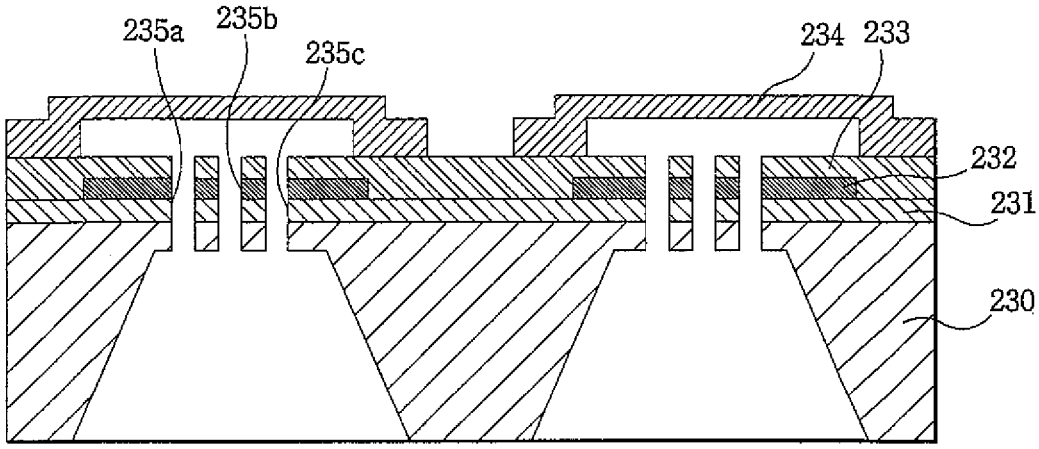
FIG. 9 is a schematic cross-sectional view illustrating a state where a plurality of microphones is formed on a substrate.

FIG. 9 is a schematic cross-sectional view illustrating a state where the plurality of microphones of FIG. 8 is formed on a substrate.

Referring to FIG. 9, the plurality of microphones may be formed in such a manner that a first isolation layer (231) is formed on a substrate (230), a plurality of bottom electrodes (232) is formed on the first isolation layer (231), a second isolation layer (233) formed on the first isolation layer (231) and encompassing the plurality of bottom electrodes (232), each of the plurality of bottom electrodes is formed with etched substrate (230) regions, each of the etched substrate regions is formed with a plurality of through holes (235*a*, 235*b*, 235*c*) that penetrate from each etched substrate (230) regions to the second isolation layer (233), and a plurality of upper electrodes (234) discretely formed from the upper surface of the second isolation layer (233) formed on each of the plurality of the bottom electrodes (232).

The plurality of upper electrodes (234) may surface from the upper surface of the second isolation layer (233), such that a space may exist between each of the upper electrodes (234) and the second isolation layer (233). Each of the etched substrate (230) regions is formed with a groove, and each of the grooves and each of the spaces may communicate with the plurality of through holes (235*a*, 235*b*, 235*c*).

The sound transmitted to the grooves may be transmitted to the spaces through the plurality of through holes (235*a*, 235*b*, 235*c*). Pressure is changed in the spaces by the transmitted sound to change the electrostatic capacity between the plurality of upper electrodes (234) and the electrodes (232). As a result, the transmitted sound can be detected. Consequently, the plurality of microphones may be produced from a single substrate using MEMS (Micro-Electromechanical Systems) or micromachining, whereby characteristic variation of each microphone can be minimized and a manufacturing cost may be reduced by batch processing to realize the miniaturization.

Figure 10:
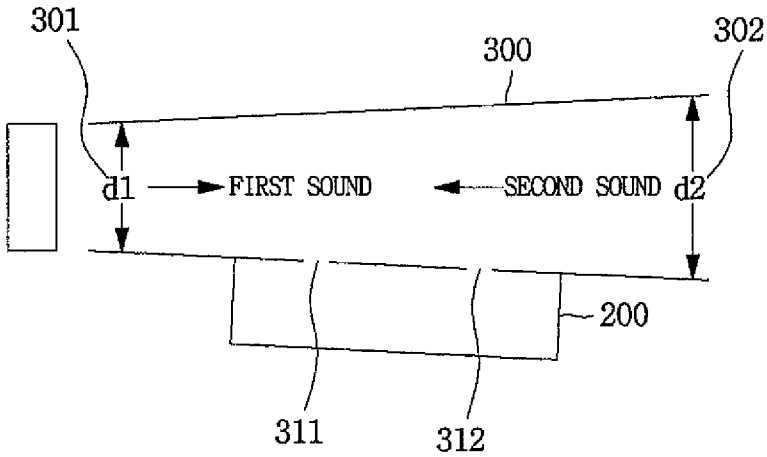
FIG. 10 is a schematic view illustrating an apparatus for transmitting and receiving sound according to still another exemplary implementation.

FIG. 10 is a schematic view illustrating an apparatus for transmitting and receiving sound according to still another exemplary implementation. Referring to FIG. 10, the apparatus is applied with a sound waveguide (300) whose diameter increases from one opening (301) to the other opening (302). In other words, a first sound inputted into said one opening (301) having a diameter (d1) may be transmitted to the said other opening (302) to amplify the sound, such that the first sound can be heard much louder and clearly by the ear drum.

Figure 11:
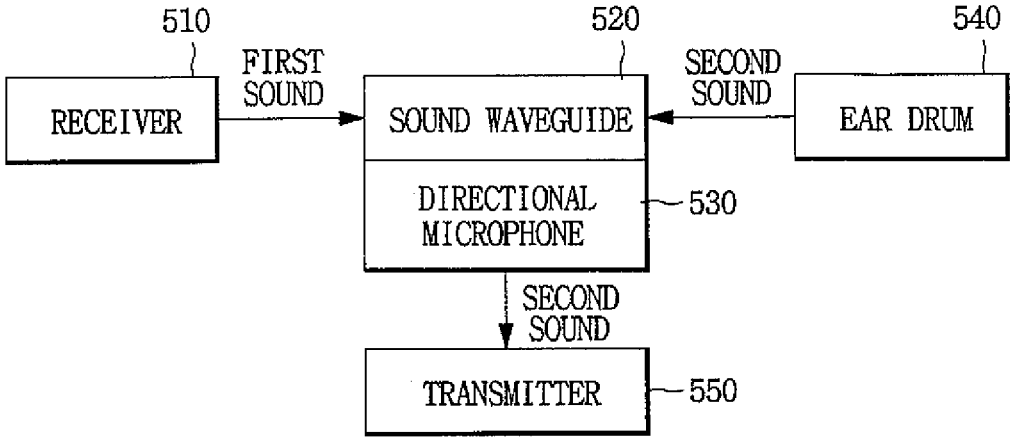
FIG. 11 is a schematic block diagram illustrating an apparatus for transmitting and receiving sound further comprising a transmitter and a receiver.

FIG. 11 is a schematic block diagram illustrating an apparatus for transmitting and receiving sound further comprising a transmitter and a receiver.

Referring to FIG. 11, the apparatus may include a receiver (510) for receiving a first sound from an external device, a sound waveguide (520) for outputting the first sound received from the receiver (510) to an ear drum (540) and receiving a second sound generated by vibration of the ear drum (540) by utterance of a user, a directional microphone (530) formed at the sound waveguide (520) to detect the second sound, and a transmitter (550) for transmitting the second sound detected by the directional microphone (530).

The receiver (510) of the apparatus thus constructed may receive the first sound wirely or wirelessly from the external device, and the first sound received by the receiver (510) maybe transmitted to the user's ear drum (540) via the sound waveguide (520).

The second sound generated by the vibration of the ear drum (540) by the utterance of the user may be inputted to the sound waveguide (520), the directional microphone (530) disposed at the sound waveguide (520) may detect the second sound.

The second sound detected by the directional microphone (530) may be transmitted to the external device by the transmitter (550). In doing so, the apparatus may reduce the interference noise between the received first sound and the second sound generated by utterance of the user for transmission to perform the full duplexing.

As the present novel concept may be implemented in several forms without departing from the spirit or essential characteristics thereof, it should also be understood that the above-described implementations are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

As apparent from the foregoing, there is an advantage in the apparatus for transmitting and receiving sound according to the present novel concept in that a directional microphone for detecting sound for transmission is applied and a sound output unit for outputting the received sound is arranged at a side of the directional microphone where sensitivity is low, thereby preventing sound coupling for received sound and sound for transmission without recourse to complicated signal processing to attenuate the echo and howling, There is another advantage in that interference noise in ear-holes caused by the received sound and utterance of a user can be attenuated even when the sound received from a sound output unit is being outputted, thereby increasing detection efficiency of the sound in the ear-holes to perform the full duplexing.

What is claimed is:

1. An apparatus for transmitting and receiving sound comprising: a sound waveguide which is a pipe formed with one opening and an other opening, wherein at least two or more through holes are formed on the pipe by passing therethrough, a first sound is inputted into said one opening and a second sound is inputted into said other opening;

a sound output unit disposed at said one opening of the sound waveguide to output the first sound to the sound waveguide; and a directional microphone for detecting the second sound by the through holes of the sound waveguide, wherein the first sound is a sound advancing from the sound output unit to an ear drum, the second sound is a sound generated from vibration of the ear drum by utterance of a user, and the first sound and the second sound cross in the directional microphone, and wherein there are two through holes at the sound waveguide, and the directional microphone has two ports, each port having a different detection sensitivity of sound and communicates with the two through holes, and the sound output unit is adjacent a port having a lower detection sensitivity.

2. The apparatus as claimed in claim 1, wherein the directional microphone comprises one directional pattern out of such patterns as a cardoid pattern, a hypercardoid pattern and a second directional pattern.

3. The apparatus as claimed in claim 1, wherein the directional microphone comprises one of a microphone detecting sound by using electromagnetism, a microphone detecting sound by using electrostatic capacity, and a microphone detecting sound by using piezoelectricity.

4. The apparatus as claimed in claim 1, wherein the directional pattern is a cardoid pattern.

5. The apparatus as claimed in claim 1, wherein the directional microphone has a secondary directional pattern, and comprises a plurality of microphones correspondingly disposed opposite to each through hole of the sound waveguide.

6. The apparatus as claimed in claim 5, wherein the plurality of microphones is manufactured from a single substrate using MEMS (Micro-Electromechanical Systems) or micromachining.

7. The apparatus as claimed in claim 5, wherein the plurality of microphones is formed in such a manner that a first isolation layer is formed on a substrate, a plurality of bottom electrodes is formed on the first isolation layer, a second isolation layer formed on the first isolation layer and encompassing the plurality of bottom electrodes, each of the plurality of bottom electrodes is formed with etched substrate regions, each of the etched substrate regions is formed with a plurality of through holes that penetrate from each etched substrate regions to the second isolation layer, and a plurality of upper electrodes discretely formed from the upper surface of the second isolation layer formed on each of the plurality of the bottom electrodes.

8. The apparatus as claimed in claim 1, wherein the said other opening of the sound waveguide is further connected to an ear plug.

9. The apparatus as claimed in claim 1, wherein the first sound is a sound received wirely or wirelessly from an external device.

10. The apparatus as claimed in claim 1, wherein the second sound is detected by the directional microphone and transmitted wirely or wirelessly to an external device.

11. The apparatus as claimed in claim 1, wherein the sound waveguide increases in diameter thereof from said one opening to the said other opening.

* * * * *